US005153537A

United States Patent [19]

Desmarest

[11] Patent Number: 5,153,537

[45] Date of Patent: Oct. 6, 1992

[54] ELECTRIC POWER TRANSMISSION SYSTEM FOR HYPERFREQUENCIES HAVING A GYROMAGNETIC EFFECT

[75] Inventor: Patrick Desmarest, Paris, France

[73] Assignee: Tekelec Airtronic, France

[21] Appl. No.: 665,696

[22] Filed: Mar. 7, 1991

[30] Foreign Application Priority Data

Mar. 9, 1990 [FR] France ..... 90 03056

[51] Int. Cl.[5] ..... H01P 1/383

[52] U.S. Cl. ..... 333/1.1; 333/24.2

[58] Field of Search ..... 333/1.1, 24.1, 24.2, 333/205

[56] References Cited

U.S. PATENT DOCUMENTS

| | | | |
|---|---|---|---|
| 3,289,112 | 11/1966 | Brown | 333/24.2 |
| 3,490,053 | 1/1970 | Nagai et al. | 333/1.1 |
| 3,510,804 | 5/1970 | Hashimoto et al. | 333/1.1 |
| 3,614,675 | 10/1971 | Konishi | 333/1.1 X |
| 3,922,620 | 11/1975 | Deutsch | 333/1.1 |
| 4,904,965 | 2/1990 | Blight et al. | 333/1.1 |
| 4,920,323 | 4/1990 | Schloemann et al. | 333/1.1 |

FOREIGN PATENT DOCUMENTS

| | | |
|---|---|---|
| 2607844 | 9/1977 | Fed. Rep. of Germany . |
| 6139703 | 2/1986 | Japan . |
| 1512605 | 6/1978 | United Kingdom . |

OTHER PUBLICATIONS

NTZ Nachrichtechnische Zeitschrift, vol. 22, No. 3, Mar. 1969 Berlin de pages 106-161; B. Wieser: "Resonanzrichtungsleitung mit konzentrierten Beuelementen für 230 MHz" p. 160, lines 1-13, FIG. 29.1.

French Search Report dated Nov. 8, 1990.

*Primary Examiner*—Paul Gensler

*Attorney, Agent, or Firm*—Ostrolenk, Faber, Gerb & Soffen

[57] ABSTRACT

An electric power transmission system for hyperfrequencies having a gyromagnetic effect. The system includes a gyrator device having at least one disc-shaped wafer of gyromagnetic material such as ferrite, one side of which is set to a reference potential, and at least two tuning networks each comprising an inductance arranged on the other side of the wafer and one end of which is connected to the ground of the gyrator device whereas the other end is connected to an input terminal of the transmission system. The gyrator device is subjected to a homogeneous magnetostatic field for energizing the gyrator device and a layer of electrically insulating material of low permittivity is provided between the inductances and the wafer of gyromagnetic material. The device is usable for circulators, isolators or filters.

19 Claims, 3 Drawing Sheets

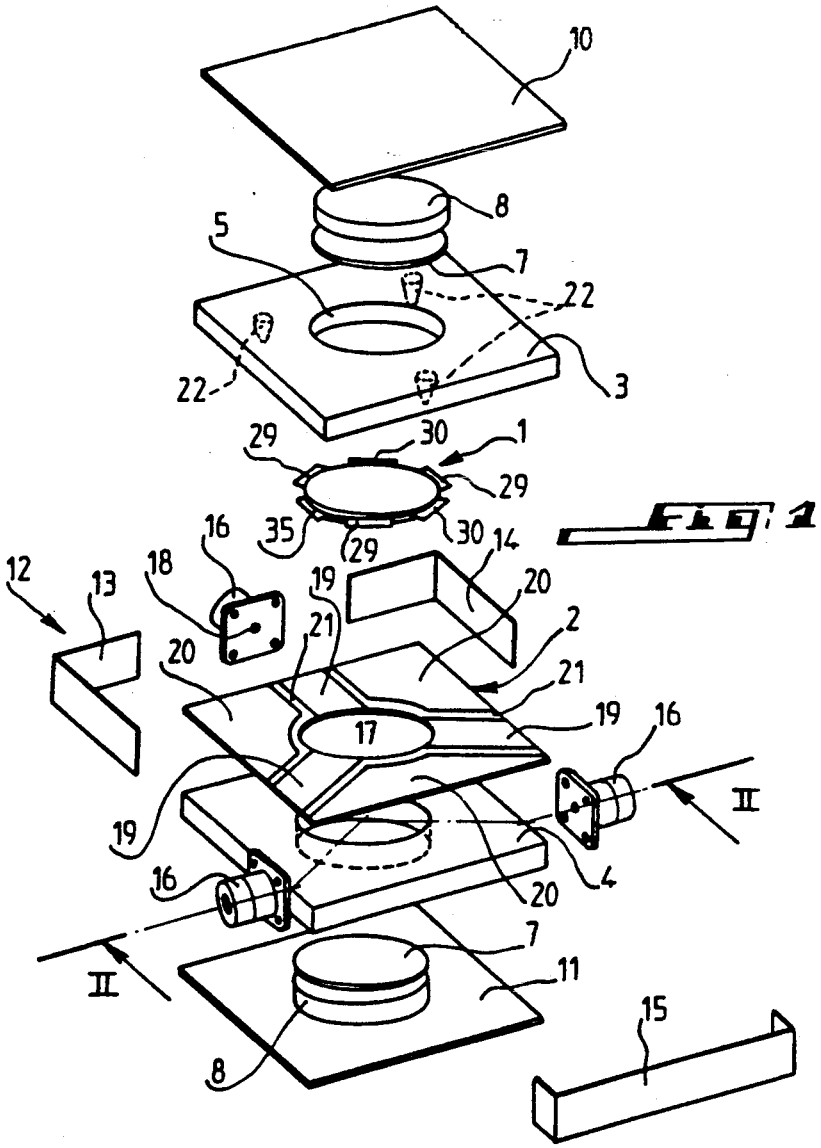
Fig. 1
Fig. 2
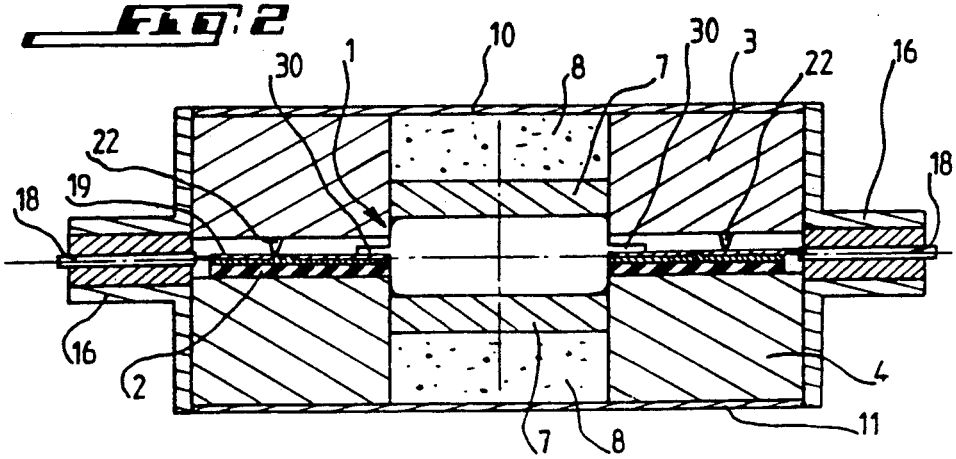

Pa
(W)
700
570
440
180
157
50
31
B
A
1
2
3
4
5
D (cm)

F
(MHz)
1623
722
541
404
324

B
A
1
2
3
4
5
D (cm)

ELECTRIC POWER TRANSMISSION SYSTEM FOR HYPERFREQUENCIES HAVING A GYROMAGNETIC EFFECT

BACKGROUND OF THE INVENTION

The invention relates to an electric power transmission system for hyperfrequencies with a gyromagnetic effect, such as a circulator, an isolator or a filter, of the type comprising a gyrator device which comprises at least one advantageously disc-shaped wafer made from a gyromagnetic material such as ferrite material, one side of which is set at a reference potential such as a metal plane which may either be or not be connected to the ground of the system, and at least two tuning networks, each comprising an inductance arranged on the other side of the wafer and one end of which is connected to the ground of the gyrator device whereas the other end is connected at an input terminal of the transmission system, the gyrator device being subjected to a homogeneous magnetostatic field for energizing the gyrator.

The utilization limits of transmission systems of this type which are known are imposed by the natural resonance frequency of the gyrator, i.e. by the frequency determined by parasitic capacitances inherent in the configuration of the component elements and of the structure of the whole. A second limit appears when it is desired to have the power transmitted through the system. In a general manner the transmitted power is proportional to the diameter of the gyromagnetic wafer used and inversely proportional to the transmission losses. The increase in the size of the gyrator device increases the parasitic capacitance and is thus attended by a reduction in the natural resonance frequency. It is moreover known that the transmission losses may be minimized by a suitable selection of the magnetic parameters as well as of an optimum coupling coefficient, i.e. close to 1. Such a coupling coefficient is obtained by increasing the number of conducting leads which form the inductance. The increase in the number of leads results again in an increase of the parasitic capacitance and therefore in a reduction of the natural reasonance frequency.

SUMMARY OF THE INVENTION

An object of the present invention is to provide a transmission system of the kind referred to hereinabove which allows at least substantially decreasing this parasitic capacitance so as to increase the natural frequency.

Another object of the invention is to allow the selection of the other parameters of the system such as the geometric dimensions of the gyrator device, the number of conducting leads of the inductances and the coupling coefficient in an advantageous fashion without this being detrimental to the natural resonance frequency.

For achieving this goal a transmission system according to the invention is provided with a layer made from an electrically insulating material and with a small permittivity disposed between the inductances and the wafer of gyromagnetic material.

According to an advantageous embodiment of the invention, the insulating layer comprises the superposition of several chips made from an insulating material of small permittivity which are interposed between the aforesaid inductances while electrically insulating the inductances from each other.

According to another advantageous embodiment of the invention, the aforesaid inductance is made as a number of conducting leads connected with one end to the ground of the gyrator device and mounted in parallel-connecting relationship, such a number ranging from 2 to 10.

BRIEF DESCRIPTION OF THE DRAWINGS

The invention will be better understood and further objects, features, details and advantages thereof will appear more clearly as the following explanatory description proceeds with reference to the accompanying diagrammatic drawings given by way of non limiting examples only illustrating several embodiments of the invention and wherein:

FIG. 1 is a perspective exploded view of an electric power transmission system according to the present invention;

FIG. 2 is a view in section taken upon a vertical plane extending through the line II—II of FIG. 1 in the assembled condition and on a larger scale;

DETAILED DESCRIPTION

Figure 5:
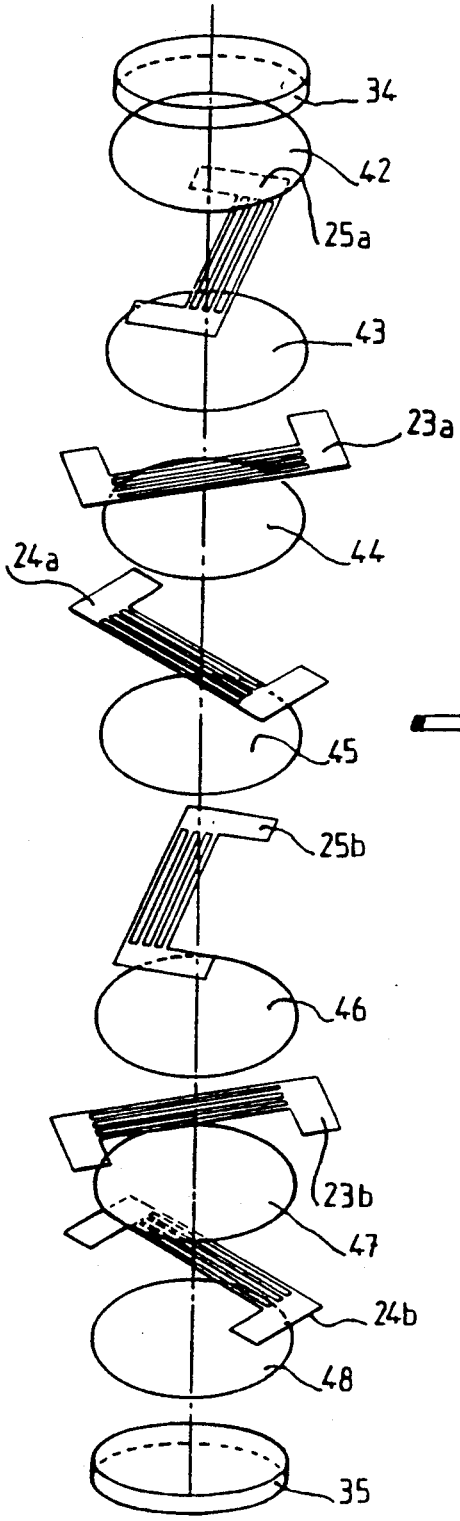
FIG. 5 shows a third embodiment of the gyrator device according to FIG. 1.

Referring to FIGS. 1 and 2 there is shown an electric power transmission system for hyper-frequencies with a gyromagnetic effect essentially comprising a gyrator device 1 adapted to be mounted onto a printed circuit chip 2 arranged between upper and lower plates 3 and 4, respectively, made from metal or from a non magnetic alloy, such as, for instance, aluminum, each plate being formed with a central opening 5 adapted to receive a polar piece 7 made, for instance, from steel and a magnet 8. An upper magnetic closing plate 10 and a lower magnetic closing plate 11 are disposed on the free outer surfaces of the upper and lower magnets 8, respectively. The whole is surrounded by a belt 12 consisting of several elements 13, 14, 15 and magnetically connecting the upper and lower closing plates 10 and 11 for making the magnetic circuit. The belt comprises three connectors 16 which are secured to three sides of the plates 3 and 4 in the assembled state of the system.

The printed circuit chip 2 exhibits in its center a recess 17 adapted to accommodate the gyrator device 1. The plate 2 carries on its top side a pattern of electrically conducting strips and zones, namely three substantially radial strips 19 which extend from the edge of the recess 17 to the edge of the plate and are adapted to be each electrically connected to the conductor 18 (FIG. 2) of one of the connectors 16, and three zones 20 which are electrically insulated at 21 from the strips 19 and are adapted to be in electric contact with the upper plate 3 which bears upon each zone 20 with a pin 22 and constitutes a ground electrode.

It should be pointed out that each strip 19 is generally connected to the corresponding conductor 18 through the medium of a matching network not shown and comprises LC-type cells as known per se.

Figure 3:
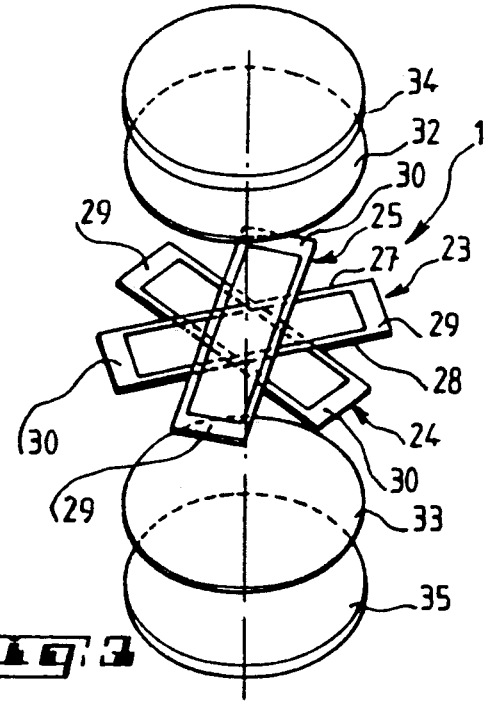
FIG. 3 is a perspective exploded view of a first embodiment of the gyrator device 1 according to FIG. 1.
Figure 4:
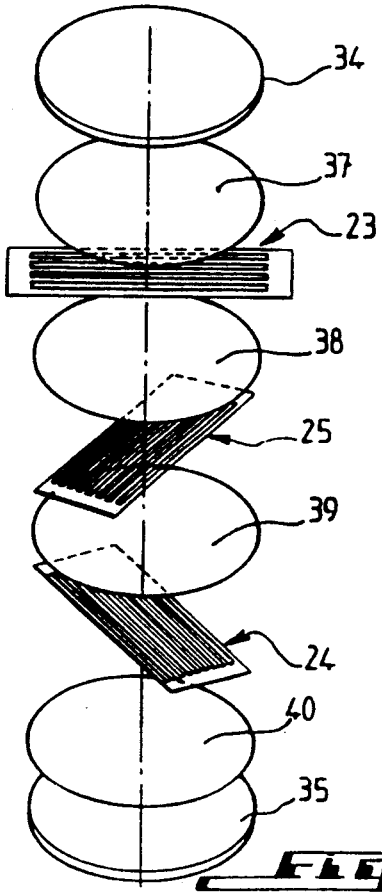
FIG. 4 is a perspective exploded view of a second embodiment of the gyrator device 1 of FIG. 1.

Referring to FIGS. 3 to 5, three embodiments of a gyrator device 1 according to the present invention will be described hereinafter.

According to a first embodiment shown in FIG. 3, the gyrator device 1 comprises a configuration of three inductances 23, 24, 25 each comprising two conducting portions or leads 27, 28 arranged in the same plane and which are parallel and connected at their ends designated at 29 and 30. These ends are made as electric connecting lugs one of which, for instance, the lug 29 is connected to one of the ground zones 20 of the printed circuit on the plate 2 and of the gyrator device whereas the other lug designated by the reference numeral 30 will be electrically connected to one of the conducting strips 19 of the printed circuit. These inductances 23 to 25 may be made from any suitable conducting metal and exhibit a self-supporting structure. The inductances are electrically insulated from one another by the interposition of a suitable insulating material. The inductances are arranged so as to be angularly spaced by 120°.

Both discs 32, 33 of circular shape in the example shown and made from an electrically insulating material with a small permittivity are arranged on either side of the configuration of the three inductances 23 to 25. These discs could be discs made from Teflon or from a dielectric material such as ceramic. On each disc 32, 33 is provided a disc 34, 35, respectively, made from a gyromagnetic material such as ferrite material. The outer face of each gyromagnetic disc therefore is in the assembled condition of the system in contact with a metal plane (the faces of poll pieces 7) which may either be or not be connected to the ground of the system. As it appears from FIG. 1, the various connecting lugs 29, 30 are radially projecting from the whole consisting of the stack of discs 32 to 35 on the central configuration of the inductances 23, 24, 25 so that they may be electrically connected to the printed circuit of the chip 2.

FIG. 4 shows an embodiment of the gyrator device 1 wherein the insulating layer of small permittivity is formed of four discs or plates of smaller thicknesses 37 to 40 which are stacked between the upper and lower gyromagnetic discs 34, 35. The three inductances 23 to 25 are each arranged between two neighboring insulating discs while being angularly spaced by 120° as shown on FIG. 3. In this embodiment each inductance comprises ten parallel leads. Each inductance may be made so as to exhibit a self-supporting structure or be deposited as a printed circuit onto one surface of one of the discs 37 to 40 while of course providing a support for the connecting lugs 29, 30. In this embodiment, the discs 37 to 40 are advantageously made from a dielectric material such as ceramic.

In the embodiment according to FIG. 5, the insulating layer with a small permittivity is formed of seven discs 42 to 48 which are stacked between the gyromagnetic discs 34, 35 with the inductances arranged therebetween in sandwich-like fashion. In this embodiment, each inductance is divided into two halves which within the whole gyrator assembly are juxtaposed and electrically connected in parallel relationship. For instance, the inductance 23 of FIGS. 3 and 4 is now formed of both half-inductances 23*a* and 23*b* interposed between the discs 43, 44 and 46, 47, respectively, i.e. between two different pairs of discs. Likewise, the inductances 24 and 25 are formed of the half-inductances 24*a*, 24*b* and 25*a*, 25*b*, respectively, and arranged between two different pairs of discs as shown on FIG. 5.

The operation of the system according to the present invention which has just been described will be described hereinafter with reference to the Figures.

The general structure of such a transmission system is known per se and therefore needs not be described in more detail. The discs made from a gyromagnetic material 34, 35 are disposed in the static magnetic field generated by the magnets 8 as clearly shown in FIGS. 1 and 2. The magnetic circuit is closed through the upper and lower closure plates 10 and 11 and the belt 12. Through the connectors 16, a perpendicular hyperfrequency field is applied to the gyromagnetic material, the wavelength of this field being very great with respect to the lengths of the axes of the gyromagnetic discs so that the field is uniform within the volumes thereof.

The interposition of an insulating layer having a small permittivity between the configuration of the inductances and each disc of gyromagnetic material permits substantially reducing the parasitic capacitance due to the sizes of the conducting strips, of the inductances and of their numbers of leads and of the thickness of the gyromagnetic material. The great reduction of this parasitic capacitance allows increasing the natural resonance frequency of the gyrator system which is given by the equation:

$$F = \left[ 2\pi \left( \frac{3}{2} L_o \cdot C\mu_{eff} \right) \right]^{-\frac{1}{2}}$$

where $L_o$ is the value of an inductance for a permeability $\mu_{eff}=1$ and C' being the sum of parasitic capacitances.

It thus becomes apparent that it is possible to increase the natural frequency, i.e. the operating frequency of the gyrator device 1 while decreasing the parasitic capacitance C'. This operating frequency constitutes the limit frequency of the system. As a matter of fact, the frequency to which the system will be tuned is determined by the mounting in parallel connecting relationship on each input or access of the gyrator device 1 of a capacitor (not shown) and the relative pass-band as well as the resistance may be changed by means of LC-type cells inserted at the input of the gyrator device.

By arranging the insulating layer having a small permittivity as one or several discs between both gyromagnetic discs 34, 35 of the device 1 a capacitance C'' is inserted which may be written as follows:

$$C'' = \Sigma_o \cdot \Sigma_r \cdot \frac{S}{e}$$

where $\Sigma_o$, $\Sigma_r$, e and S designate the permittivity of the vacuum, the relative permittivity of the insulating material, the thickness and the surface area of the insulating layer, respectively.

This capacitance C'' may be assumed to be connected in series with the parasitic capacitance C' and by selecting the smallest possible $\Sigma_r$ and the greatest possible thickness, the inserted capacitance C'' takes such a small value that the total capacitance is substantially decreased. By way of example, Teflon exhibits an $\Sigma_r=2$. As to the thickness of the insulating layer in the embodiment according to FIG. 5, each Teflon disc could have a thickness of 0.1 mm which gives a total thickness of the insulation of 0.7 mm. In a general manner the maximum thickness is a function of the thicknesses of the gyromagnetic discs and is roughly determined by the term $$E_{max} = \frac{2H}{3}$$

where H is the thickness of the gyromagnetic disc.

It has been proved that the limit frequency F of a gyrator according to the invention is multiplied by $\sqrt{K}$ with respect to a conventional gyrator if K is the coefficient by which the parasitic capacitance has been decreased by providing insulating layers of small permittivities as just described.

The addition of the insulation of small permittivity and of relatively great thickness of from 1 to several tenths of a millimeter also permits increasing the size of the discs of gyromagnetic material and the number of leads constituting the inductances and thus to improve the coupling coefficient. The admissible power may be multiplied by two or three taking into account the smaller thermal resistance, the larger heat exchange surfaces and improved energy distribution inside of the gyromagnetic material. Owing to the measures just stated, it is possible to decrease the losses and to increase the relative frequency band.

Figure 7:
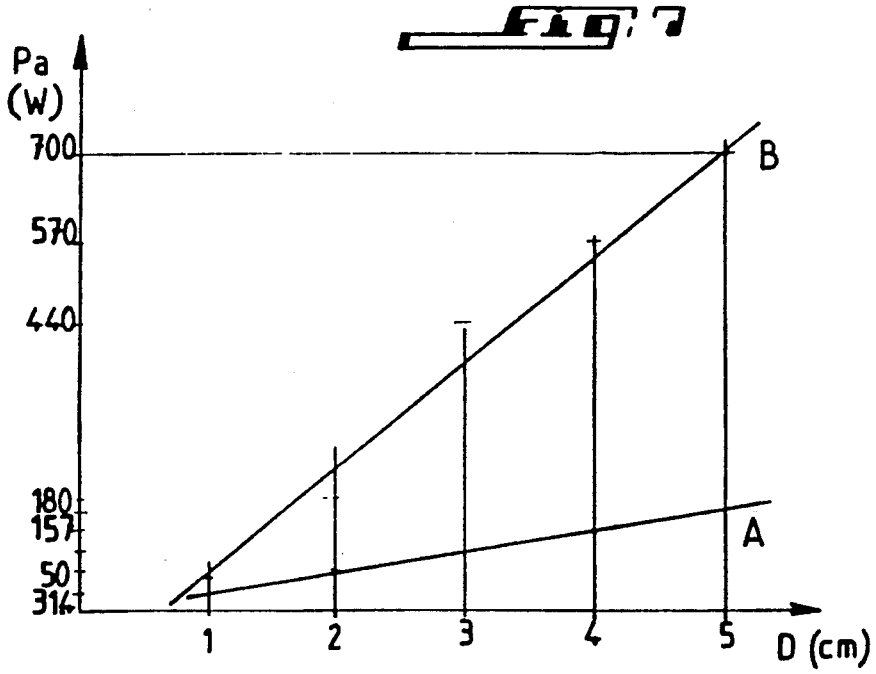
FIGS. 6 and 7 show curves defining, first, the relationship between the limit frequency and the admissible power and, second, the diameter of the gyromagnetic wafer, respectively.
Figure 6:
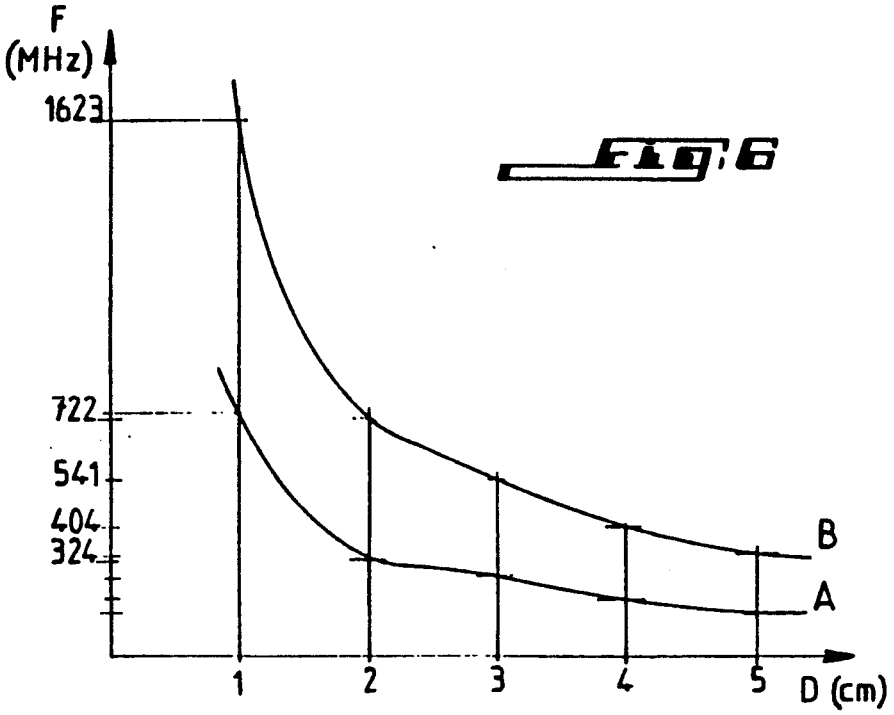

FIGS. 6 and 7 which show the limit frequency F (in MHz) and the admissible power Pa (in Watts), respectively, versus the diameter D of the disc of gyromagnetic material such as ferrite material (in cm), confirm what has just been specified. In each Figure the curve A gives the values of a typical system using the conventional structure whereas the curve B gives the values which have been measured under the same conditions as for the curve A, of a system according to the invention, i.e. comprising an insulation of small permittivity and of great thickness between the configuration of inductances and the discs of gyromagnetic ferrite.

It has, moreover, been discovered that the relative frequency passbands of a system according to the invention may have a width which is twice as large as that of a known system in the low frequency range of 30 MHz.

The improvements just mentioned may be applied to various types of systems, in particular, to all those which require either a reciprocal or non reciprocal coupling such as circulators, isolators and filters.

The invention such as described with reference to the Figures may be modified in various ways without departing from the scope of the invention. The techniques for practicing the invention may be of various kinds. The layer added to reduce the parasitic capacitance may be an insulation of the adhesive or adhesive type, a dielectric such as ceramic with a small permittivity or the like. The printed circuits may be with a single or double face or of the multilayer kind. The shapes of the wafers of gyromagnetic material may have any suitable known shape. The same holds true for the insulating layer and the inductances. The number of wafers and of insulating layers may vary. The invention is also applicable to a system structure using one single gyromagnetic wafer only onto which will be laid the configuration of inductances with the interposition of at least one insulating layer of small permittivity. The number of access connections may, of course, be different and vary from two to a higher number.

What is claimed is:

1. An electric power transmission system for hyperfrequencies having a gyromagnetic effect, the system comprising a gyrator device having at least one substantially disc-shaped wafer comprising a gyromagnetic material, the wafer having first and second sides, the first side being in electrical contact with an element to which a reference potential is applied, and further comprising at least two tuning networks, each network comprising an inductance, the inductances both located on the second side of the wafer and each inductance having first and second ends, the first end connected to a potential applied to the gyrator device comprising a ground potential and the second end connected to an input terminal of the transmission system, means for energizing the gyrator device comprising means for subjecting the gyrator device to a homogeneous magnetostatic field, said gyrator device having a parasitic capacitance and a natural resonance frequency determined by said parasitic capacitance, a layer of an electrically insulating material having a low permittivity being arranged between said inductances and said wafer of gyromagnetic material, said insulating layer located between said inductances and said wafer comprising means for reducing the parasitic capacitance of the gyrator device, said parasitic capacitance decreasing with increasing thickness of the insulating layer and with decreasing relative permittivity of the insulating layer material.

2. A system according to claim 1, wherein the inductances together as a single unit have first and second sides, and further comprising a second wafer of gyromagnetic material, said two wafers being disposed so that one is on each side of the unit of inductances and further comprising additional insulating layers, the additional insulating layers comprising a superposition of a plurality of plates of electrically insulating material of low permittivity which are interposed between the inductances while electrically insulating them from each other and further comprising an insulating layer between the inductances and the second wafer of gyromagnetic material.

3. A system according to claim 2, wherein at least one inductance comprises a circuit printed onto a face of an insulating plate.

4. A system according to claim 2, wherein the inductances are provided as flat circuit elements each having a plurality of parallel conducting leads disposed in a common plane and connected at respective ends thereof to the ground potential and to the input of the system.

5. A system according to claim 3, wherein each inductance comprises a number of conducting leads lying between 2 and 10.

6. A system according to claim 4, wherein each inductance comprises two parallel disposed inductance portions and each inductance portion is disposed between two insulating plates.

7. A system according to claim 6, wherein each inductance portion comprises a circuit printed onto a face of an insulating disc.

8. A system according to claim 1, comprising three inductances angularly spaced by 120°.

9. A system according to claim 1, further comprising a second wafer of gyromagnetic material, said second wafer being disposed on a side of said inductances opposite said first wafer, and further comprising an insulating layer between the inductances and the second wafer.

10. A system according to claim 1, wherein the gyromagnetic material comprises a ferrite material.

11. An electric power transmission system for hyperfrequencies having a gyromagnetic effect, the system comprising a gyrator device having first and second substantially disc-shaped wafers each comprising a gyromagnetic material, each wafer having first and second sides, the first side of the first wafer being in electrical contact with an element to which a reference potential is applied, and further comprising at least two tuning networks, each network comprising an inductance, the inductances located between the first and second wafers facing the second side of each wafer, each inductance having first and second ends, the first end connected to a potential applied to the gyrator device comprising a ground potential and the second end connected to an input terminal of the transmission system, means for energizing the gyrator device comprising means for subjecting the gyrator device to a homogeneous magnetostatic field, said gyrator device having a parasitic capacitance and a natural resonance frequency determined by said parasitic capacitance, a layer of an electrically insulating material having a low permittivity being arranged between said inductances and the second sides of each of said wafers of gyromagnetic material, and further comprising additional insulating layers of low permittivity interposed between the inductances and electrically insulating them from each other.

12. A system according to claim 11, wherein the insulating layer of low permittivity comprises means for reducing the parasitic capacitance of the gyrator device.

13. A system according to claim 12, wherein the parasitic capacitance decreases with increasing thickness of the insulating layers and with decreasing relative permittivity of the insulating layer material.

14. A system according to claim 11, wherein the inductances are provided as flat circuit elements each having a plurality of parallel conducting leads disposed in a common plane and connected at respective ends thereof to the ground potential and to the input of the system.

15. A system according to claim 14, wherein each inductance comprises two parallel disposed inductance portions and each inductance portion is disposed between two insulating plates.

16. A system according to claim 11, wherein at least one inductance comprises a circuit printed onto a face of an insulating plate.

17. A system according to claim 11, wherein each inductance comprises a number of conducting leads lying between 2 and 10.

18. A system according to claim 11, comprising three inductances angularly spaced by 120°.

19. A system according to claim 11, wherein the gyromagnetic material comprises a ferrite material.

* * * * *